US008025049B2

(12) United States Patent
Post

(10) Patent No.: US 8,025,049 B2
(45) **Date of Patent: *Sep. 27, 2011**

(54) HIGH EFFICIENCY FURNACE HAVING A BLOWER HOUSING WITH AN ENLARGED AIR OUTLET OPENING

(75) Inventor: Steven W. Post, Cassville, MO (US)

(73) Assignee: RBC Horizon, Inc., Beloit, WI (US)

( * ) Notice: Subject to any disclaimer, the term of this patent is extended or adjusted under 35 U.S.C. 154(b) by 432 days.

This patent is subject to a terminal disclaimer.

(21) Appl. No.: 11/935,726

(22) Filed: Nov. 6, 2007

(65) Prior Publication Data

US 2009/0114205 A1 May 7, 2009

(51) Int. Cl.
*F04D 29/44* (2006.01)

(52) U.S. Cl. ..... 126/110 R; 126/99 R; 126/110 A; 415/204; 415/206

(58) Field of Classification Search ..... 126/110 R, 126/99 R, 110 A; 415/204, 206; *F04D 29/44*
See application file for complete search history.

(56) References Cited

U.S. PATENT DOCUMENTS

| | | | | | |
|---|---|---|---|---|---|
| 17,664 | A | * | 6/1857 | Braugh | 415/204 |
| 82,736 | A | * | 10/1868 | Mitchell | 415/97 |
| 662,395 | A | * | 11/1900 | Davidson | 415/204 |
| 675,375 | A | * | 6/1901 | Davidson | 415/201 |
| 839,273 | A | * | 12/1906 | Davidson | 415/58.6 |
| RE12,796 | E | * | 5/1908 | Davidson | 415/204 |
| RE12,797 | E | * | 5/1908 | Davidson | 415/204 |
| RE12,798 | E | * | 5/1908 | Davidson | 415/204 |
| 1,111,250 | A | * | 9/1914 | Davidson | 415/208.1 |
| 1,138,083 | A | * | 5/1915 | Carrier | 415/204 |
| 1,462,557 | A | * | 7/1923 | Kuenzel, Jr. | 415/99 |
| 1,892,930 | A | | 2/1930 | Burman | |
| 1,875,881 | A | * | 9/1932 | Morse | 415/206 |
| 1,877,905 | A | * | 9/1932 | le Grand | 165/110 |
| 1,895,488 | A | | 1/1933 | Reisinger | |

(Continued)

FOREIGN PATENT DOCUMENTS

DE 19709193 A1 * 10/1997

(Continued)

OTHER PUBLICATIONS

JP 61-138900 A Translation; FLS, Inc., Washington, D.C. Sep. 2010; pp. 1-10.

*Primary Examiner* — Steven B McAllister
*Assistant Examiner* — Daniel E Namay
(74) *Attorney, Agent, or Firm* — Thompson Coburn LLP

(57) ABSTRACT

An air distribution blower housing for a furnace is designed with an enlarged air outlet opening that slows down and spreads out the air flow from the blower housing over a greater area of the furnace heat exchanger. The blower housing thereby enables less air pressure drop through the heat exchanger, which increases the efficiency of the blower motor operation. The design of the blower housing also efficiently turns the velocity head of the air flow through the housing to usable static air pressure at the housing air outlet. The enlarged air outlet opening of the blower housing is achieved without increasing the exterior diameter dimensions of the blower housing by utilizing a volute outer wall of the blower housing that has an exponentially increasing expansion angle in the direction of air flow through the blower housing.

51 Claims, 7 Drawing Sheets

U.S. PATENT DOCUMENTS

| | | | | | |
|---|---|---|---|---|---|
| 1,935,120 | A | | 11/1933 | Hagen | |
| 2,155,631 | A | * | 4/1939 | Anderson | 415/97 |
| 2,165,069 | A | * | 7/1939 | Reynolds | 416/178 |
| 2,225,398 | A | * | 12/1940 | Hamblin | 415/119 |
| 2,301,857 | A | * | 11/1942 | Criqui | 415/170.1 |
| 2,322,357 | A | * | 6/1943 | Hagen | 415/204 |
| 2,441,411 | A | * | 5/1948 | Hagen | 416/188 |
| 2,564,775 | A | * | 8/1951 | Besser | 126/110 R |
| 3,098,603 | A | * | 7/1963 | Baker | 415/204 |
| 3,191,851 | A | * | 6/1965 | Wood | 415/119 |
| 3,227,150 | A | * | 1/1966 | Reznick et al. | 126/106 |
| 3,382,862 | A | * | 5/1968 | Martz | 126/110 R |
| 3,407,995 | A | * | 10/1968 | Kinsworthy | 415/94 |
| 3,481,321 | A | * | 12/1969 | Reichelderfer | 126/99 R |
| 3,561,906 | A | * | 2/1971 | Fermer | 415/206 |
| 3,638,636 | A | * | 2/1972 | Marshall et al. | 126/110 R |
| 3,820,526 | A | * | 6/1974 | Van Vliet | 26/110 R |
| 3,846,040 | A | * | 11/1974 | Dennis | 415/204 |
| 3,950,835 | A | * | 4/1976 | Bennink et al. | 29/888.025 |
| 4,035,610 | A | * | 7/1977 | Roth | 392/349 |
| 4,419,049 | A | * | 12/1983 | Gerboth et al. | 415/212.1 |
| 4,828,456 | A | * | 5/1989 | Bodzian et al. | 415/211.1 |
| 4,917,572 | A | * | 4/1990 | Van Houten | 415/206 |
| 5,141,397 | A | | 8/1992 | Sullivan | |
| 5,257,904 | A | | 11/1993 | Sullivan | |
| 5,301,654 | A | * | 4/1994 | Weber et al. | 126/110 R |
| 5,309,890 | A | * | 5/1994 | Rieke et al. | 126/110 R |
| 5,368,010 | A | * | 11/1994 | Weber et al. | 126/110 R |
| 5,375,586 | A | * | 12/1994 | Schumacher et al. | 126/110 R |
| 5,377,662 | A | | 1/1995 | Mills et al. | |
| 5,379,750 | A | | 1/1995 | Larsen et al. | |
| 5,379,751 | A | * | 1/1995 | Larsen et al. | 126/110 R |
| 5,380,193 | A | * | 1/1995 | Williams et al. | 431/178 |
| 5,406,933 | A | * | 4/1995 | Lu | 126/110 R |
| 5,448,986 | A | * | 9/1995 | Christopher et al. | 126/110 R |
| 5,570,996 | A | | 11/1996 | Smiley, III | |
| 5,601,400 | A | | 2/1997 | Kondo et al. | |
| 5,813,834 | A | * | 9/1998 | Hopfensperger et al. | 415/206 |
| 6,318,358 | B1 | * | 11/2001 | Gatley, Jr. | 126/110 R |
| 6,439,839 | B1 | * | 8/2002 | Song et al. | 415/119 |
| 6,578,629 | B1 | * | 6/2003 | Trent | 165/274 |
| 6,585,484 | B2 | * | 7/2003 | Rosenthal et al. | 415/201 |
| 6,821,088 | B2 | * | 11/2004 | Sakai et al. | 415/204 |
| 7,334,986 | B2 | * | 2/2008 | Sohn et al. | 415/204 |
| 7,500,825 | B2 | * | 3/2009 | Hanai | 415/204 |
| 2002/0014233 | A1 | * | 2/2002 | Gatley et al. | 126/110 R |
| 2003/0012649 | A1 | * | 1/2003 | Sakai et al. | 415/206 |
| 2004/0062646 | A1 | * | 4/2004 | Nomura | 415/206 |
| 2007/0274833 | A1 | * | 11/2007 | Sakai et al. | 416/204 R |
| 2009/0252605 | A1 | | 10/2009 | Lyons | |

FOREIGN PATENT DOCUMENTS

| | | |
|---|---|---|
| JP | 61138900 | 6/1986 |

* cited by examiner

HIGH EFFICIENCY FURNACE HAVING A BLOWER HOUSING WITH AN ENLARGED AIR OUTLET OPENING

BACKGROUND OF THE INVENTION

1. Field of the Invention

The present invention pertains to a high efficiency furnace and a low profile furnace that each comprise an air distribution blower housing that is designed with an enlarged air outlet opening. The enlarged outlet opening slows down and spreads out the airflow from the blower housing over a greater area of the secondary heat exchanger and the primary heat exchanger of the high efficiency furnace, and over a greater area of the heat exchanger of a low profile furnace. Thus, the blower housing enables less air pressure drop through the heat exchangers, which increases the efficiency of the blower operation. The design of the blower housing also efficiently turns the velocity head of the air flow to usable static pressure at the housing air outlet. The enlarged air outlet opening of the blower housing is achieved without increasing the exterior dimensions of the blower housing. This is accomplished by utilizing a unique design volute outer wall of the blower housing that has an exponentially increasing expansion angle in the direction of airflow through the blower housing.

2. Description of Related Art

High efficiency residential natural gas powered furnaces are becoming more and more common. A furnace of this type is defined in the industry as a 90+ AFUE (Annul Fuel Utilization Efficiency) furnace. A 90+ furnace converts more than 90% of the fuel supplied to the furnace to heat, with the remainder being lost through the chimney or exhaust flue. These particular types of furnaces employ a primary heat exchanger found in most any type of furnace, plus an additional secondary heat exchanger. The secondary heat exchanger increases the capacity of the furnace to convert the heat of the gas combustion to the distribution airflow from the furnace, and thereby defines the furnace as a high efficiency furnace.

The typical construction of a high efficiency furnace 10 is shown in FIG. 1. The furnace 10 has an external housing enclosure 12 with an interior volume 14. The dimensions of the furnace enclosure 12 are determined to contain all of the component parts of the furnace in the enclosure 12, without the enclosure occupying a significant area in the residence in which the furnace is installed. Several portions of the side walls of the furnace enclosure 12 shown in FIG. 1 have been removed to illustrate the interior components of the furnace.

An air inlet opening is typically provided in a side wall of the furnace enclosure. The air inlet opening can be covered by a grill or is a vaned opening that allows ambient air in the environment surrounding the enclosure 12 to easily pass through the opening and enter the enclosure interior 14. Alternatively and more frequently, the air inlet opening of the furnace enclosure communicates with a cold air return duct system of the residence. The cold air return duct system channels ambient air from throughout the residence to the furnace enclosure. The direction of ambient airflow into the furnace enclosure interior 14 is represented by the arrow 16 labeled (AIRFLOW) in FIG. 1.

The furnace enclosure also has an air distribution outlet opening 18. The outlet opening communicates with an air distribution conduit or duct system of the residence in which the furnace is installed. In FIG. 1, the air distribution outlet opening is located at the top of the enclosure 12. The air heated by the high efficiency furnace 10 is discharged to the air distribution conduit system (not shown) through the distribution air outlet opening 18.

In the typical construction of a high efficiency furnace represented in FIG. 1, a primary heat exchanger 22 is located at the top of the enclosure 12 adjacent the distribution air outlet opening 18. A secondary heat exchanger 24 that qualifies the furnace as a high efficiency furnace is located directly below the primary heat exchanger 22.

An air distribution blower 26 that draws ambient air into the furnace enclosure 12 is positioned just below the secondary heat exchanger 24. A motor (not shown) of the blower rotates a fan wheel 28 in the interior of the blower in a clockwise direction as viewed in FIG. 1. This rotation of the fan wheel 28 draws the ambient air into the blower 26 and pushes the ambient air out of the blower through the secondary heat exchanger 24, then through the primary heat exchanger 22, and then out of the enclosure through the air distribution outlet opening 18.

A typical blower 26 includes a blower housing that contains the fan wheel 28. The typical blower housing includes an exterior or outer wall 32 having a scroll or volute configuration. The outer wall 32 spirals around the fan wheel 28 in the direction of fan wheel rotation. A pair of side walls 34, only one of which is shown in FIG. 1, cover over opposite sides of the volute outer wall 32 and enclose the interior of the blower 26.

As shown in FIG. 1, the typical volute outer wall 32 of the blower housing has a constant expansion angle as it extends in the fan wheel rotation direction around the fan wheel. What is meant by expansion angle is the angle at which the outer wall expands in the direction of fan wheel rotation from any point on the exterior of the outer wall 32. In the typical construction of a blower housing outer wall 32 such as that shown in FIG. 1, this expansion angle is constant for all points along the volute outer wall 32 in the rotation direction, resulting in a gradually increasing distance between the outer circumference of the fan wheel 28 and the outer wall 32 as the outer wall extends in the rotation direction around the fan wheel.

The air distribution blower 26 of the typical high efficiency furnace represented in FIG. 1 has been found to be disadvantaged in that the flow of air directed from the blower is primarily concentrated on only small portions of the secondary heat exchanger 24 and the primary heat exchanger 22. The air flow directed from the blower through the portions of the heat exchangers is represented by the arrows 34 shown in FIG. 1. As seen in FIG. 1, the scroll configuration of the volute outer wall 32 and the close positioning of the fan wheel 28 to the interior surface of the outer wall 32 primarily concentrates the flow of air through the reduced areas of the secondary heat exchanger 24 and the primary heat exchanger 22 shown to the left in FIG. 1. This reduces the efficiency of heat transfer from the heat exchangers to the air flow. The concentration of the airflow to reduced areas of the secondary 24 and the primary 22 heat exchanger also results in a significant pressure drop. This additional pressure drop requires additional blower horsepower, i.e. a larger blower motor. The requirement for a larger blower motor also decreases the efficiency of the furnace.

SUMMARY OF THE INVENTION

The present invention overcomes the efficiency problems associated with the constructions of prior art furnace blowers by providing a blower with a unique housing design that spreads out the distribution airflow over the secondary heat exchanger to a larger extent than the existing blowers of the prior art. This enables the blower to operate with less of a pressure drop through the heat exchangers than that of prior art blowers. The scroll design of the blower housing also efficiently turns the velocity head of the air flow through the housing to usable static air pressure. In addition, it has been found through testing that the blower housing design of the invention applied to a low profile blower has a similar static efficiency to that of a regular profile blower. This enables the design of the blower housing to be employed in low profile 80+ furnaces to provide an efficiency gain, even though there is no secondary heat exchanger in the low profile furnace.

In the typical construction of an air distribution blower, the pressure loss is proportional to the airflow velocity squared through a given restriction of the blower housing. Just a 15 percent increase in a two dimensional rectangular plane that represents the effective flow area across the secondary heat exchanger of the furnace can potentially create a (1.15×1.15=1.3225), (1/1.3225=0.756) 25% increase in efficiency due to air pressure loss at the secondary heat exchanger.

With this in mind, the high efficiency furnace of the present invention employs a blower housing with an enlarged air outlet opening, while the exterior dimensions of the blower housing remain substantially the same as those of the prior art blower housing used in a high efficiency furnace.

The blower housing of the present invention employs a fan wheel with forward curved impeller blades for low noise and for reducing the size of the fan wheel. Fan wheels with forward curved impeller blades are known to create large amounts of pressure and airflow for a relatively small size of fan wheel.

To obtain a large air outlet opening in the blower housing without increasing the exterior dimensions of the blower housing, the present invention utilizes an exponentially increasing expansion angle along the length of the blower housing volute shaped outer wall. Where the expansion angle of the volute outer wall of prior art blower housings increases at a constant rate, the expansion angle of the volute outer wall of the blower housing of the present invention increases exponentially as the outer wall extends around the fan wheel in the rotation direction of the fan wheel. The exponentially increasing expansion angle of the volute outer wall provides a very large air outlet opening while still having a volute shape around the entire length of the blower housing outer wall following the outer wall cutoff.

In a preferred embodiment, the expansion angle of the volute outer wall increases at a first exponential rate as it extends around the fan wheel from the cutoff of the housing through more than one-half of the outer wall circumference, and then increases at a second, larger exponential rate through to the end of the volute shape of the outer wall.

BRIEF DESCRIPTION OF THE DRAWINGS

Further features of the invention are set forth in the following detailed description of the invention and in the drawing figures.

DETAILED DESCRIPTION OF THE PREFERRED EMBODIMENT

Figure 1:
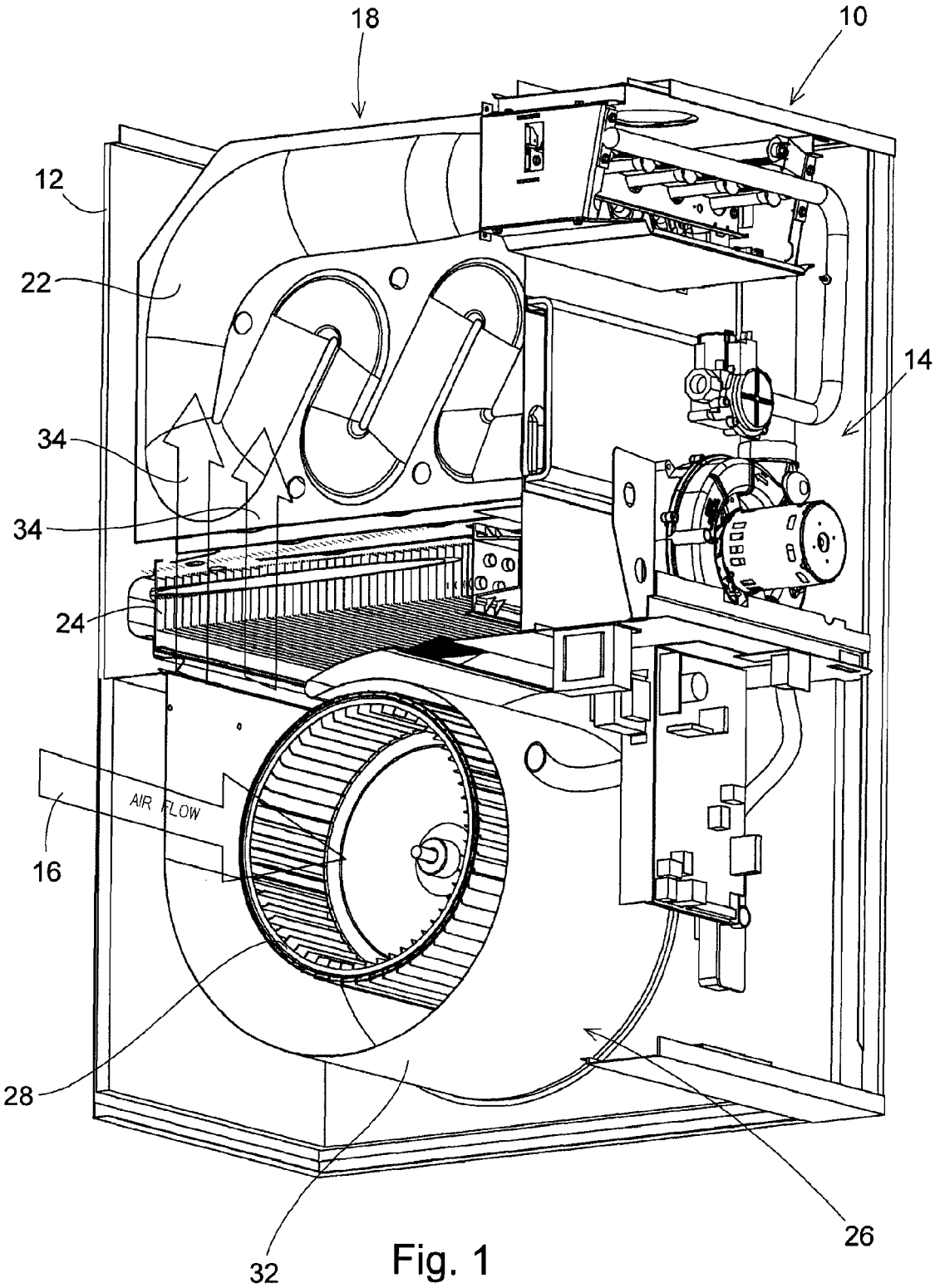
FIG. 1 is a partial view of the construction of a prior art high efficiency furnace.
Figure 2:
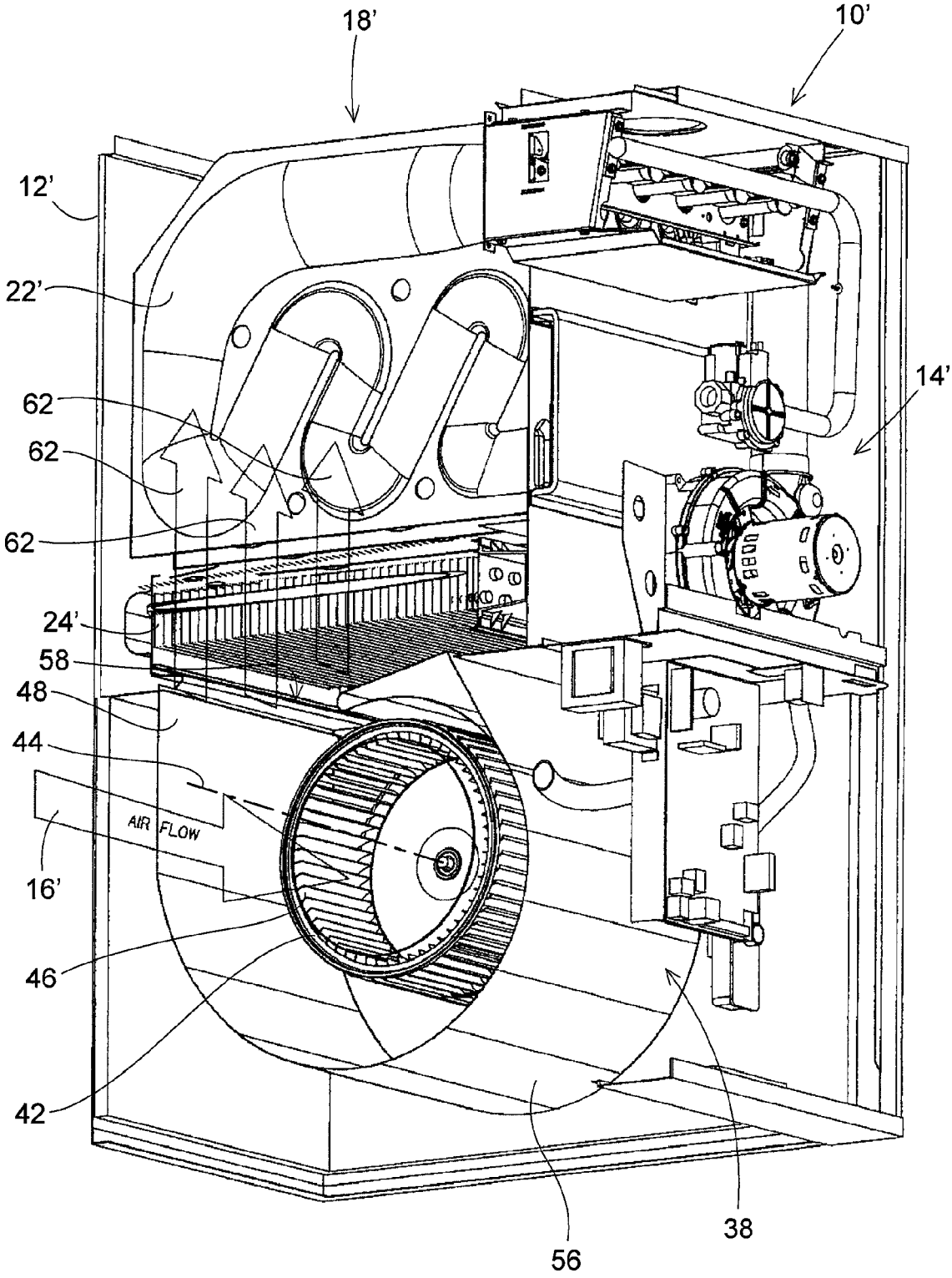
FIG. 2 is a partial view of the high efficiency furnace of FIG. 1 employing the unique blower housing of the present invention.

FIG. 2 is a perspective, cut away view of the high efficiency furnace of the invention that employs a blower housing having an enlarged air outlet opening. The furnace of the invention is primarily constructed in the same manner as known high efficiency furnaces. The difference in the furnace of the invention is in the unique design of the blower housing of the furnace. This unique design of the blower housing provides a superior distribution of air flow through the secondary and primary heat exchangers of the furnace, and thereby reduces the horsepower required by the distribution blower motor enabling an increase in the efficiency of the high efficiency furnace. Because much of the construction of the furnace shown in FIG. 2 is the same as that of FIG. 1, the same component parts of the furnace of FIG. 2 will be described only generally and are identified by the same reference numbers used in identifying the component parts in FIG. 1, but with the reference numbers being followed by a prime (').

The high efficiency furnace 10' of the present invention also includes an external housing enclosure 12' that contains the interior volume 14' of the furnace. Only a rear wall and a left side wall of the furnace enclosure 12' are shown in FIG. 2. The front wall and right side wall have been removed to provide a view of the interior components of the furnace. The front wall of the furnace enclosure is provided with an air inlet opening that allows ambient air of the residence in which the furnace is used to enter into the enclosure interior 14'. The air inlet opening is often communicated with a cold air return duct system of the residence. The flow of ambient air is represented by the arrow 16' in FIG. 2. Air that is heated by the furnace 10' is discharged to an air distribution conduit system of the residence (not shown) through a distribution air outlet opening 18'. The distribution air outlet opening 18' is positioned at the top of the enclosure shown in FIG. 2.

The primary heat exchanger 22' is positioned at the top of the enclosure interior volume 14' adjacent the distribution air outlet opening 18'. The secondary heat exchanger 24' is positioned just below the primary heat exchanger 22'. The use of both a primary heat exchanger and a secondary heat exchanger qualifies the furnace of the invention as a high efficiency furnace, or a 90+ AFUE furnace.

The blower 38 of the invention is positioned in the enclosure interior 14' at the same position as the prior art blower 26, i.e., just below the secondary heat exchanger 24'. Comparing the prior art of FIG. 1 with the furnace of the invention shown in FIG. 2, it can be seen that the blower 38 of the invention employs a fan wheel 42 having a smaller circumferential dimension and a smaller diameter dimension from the fan wheel 28 of the prior art. The fan wheel has an axis of rotation 44 that defines mutually perpendicular axial and radial directions relative to the blower 38. As shown in FIG. 2, the fan wheel rotates in a clockwise rotation direction when the fan is operating. In the preferred embodiment, the fan wheel 42 is comprised of a plurality of forward curved fan blades 46. The forward curved fan blades 46 of the fan wheel 42 reduce the noise of operation of the fan wheel 42. Furthermore, the air flow moving through the fan wheel 42 is concentrated in the last half of the scroll shaped outer wall of the blower housing, and especially in the last 90 degrees of the scroll shaped outer wall where the expansion angle of the outer wall exceeds 10 degrees. This creates a higher velocity of air flow through the forward curved fan blades 46, which increases the static pressure gained on the fan wheel 42 due to the coriollis effect. The higher air flow velocity also increases the velocity head of the air flow off of the forward curved blades 46. This effect reduces the size of the fan wheel required for an equal powered blower, and increases the efficiency of the blower due to the greater pressure being generated on the fan wheel blades.

The overall size of the blower housing 48 of the invention remains substantially the same size as the distribution blower 26 of the prior art, and maintains approximately the same blower only efficiency. This enables the blower 38 to be used in a conventionally sized furnace enclosure. With these size restrictions, enlarging the air outlet opening of the blower housing is a goal not easily achieved.

The apparent way to increase the exhaust area size of the blower housing air outlet opening is to increase the expansion angle of the blower housing outer wall. However, the prior art practice has been to design blower housings with a constant expansion angle. Increasing the expansion angle of the blower housing outer wall creates an extremely large blower housing that does not fit adequately in the typical furnace enclosure. The resultant additional size of the furnace enclosure needed to house a blower housing having an increased expansion angle creates a negative aspect for the consumer, i.e., the furnace enclosure requires more space in the consumer residence. Additionally, the manufacturer of the furnace must add cost to make the larger enclosure to accommodate the blower housing. Thus, merely increasing the exhaust area of the air outlet opening of a blower housing by increasing the expansion angle of the blower housing outer wall is not a viable option.

Figure 3:
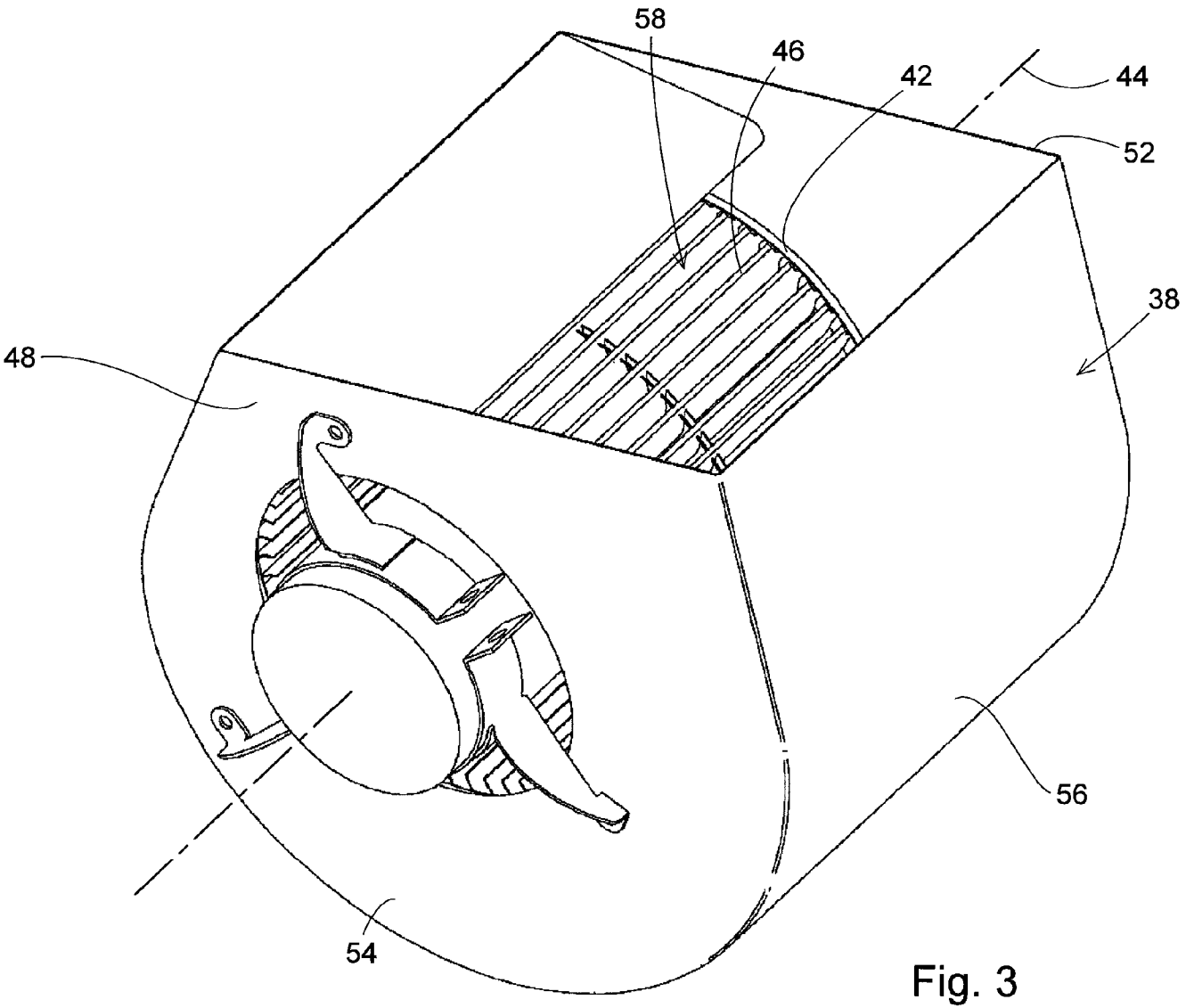
FIG. 3 is a perspective view of the opposite side of the blower housing in FIG. 2, removed from the furnace enclosure.

FIG. 2 shows one side of the blower housing 48 of the invention. FIG. 3 shows the opposite side of the blower housing 48, with the blower housing having been removed from the high efficiency furnace enclosure 12'. The opposite first 52 and second 54 side walls of the blower housing are constructed in the typical manner as prior art blower housings and are basically flat, parallel side walls positioned at axially opposite ends of the fan wheel 42. An air inlet opening is provided in the first side wall 52, and an opening that accommodates the motor that rotates the fan wheel 42 is provided in the second side wall 54. The side walls of the blower housing of the invention are basically the same as those of the prior art.

To obtain a large exhaust area of the blower housing air outlet opening, the blower housing 48 of the present invention utilizes an exponentially increasing expansion angle in the design of the blower housing volute outer wall 56. FIG. 2 shows the blower housing 48 positioned in the high efficiency furnace 10', with the first side wall being removed to show the position of the fan wheel 42 in the interior of the blower housing 48 and the relative positioning of the blower housing 48 in the furnace 10'. As shown in FIG. 2, the novel configuration of the blower housing outer wall 56 creates an enlarged air outlet opening 58 of the blower housing. This enlarged air outlet opening 58 directs distribution air over a larger area of the secondary heat exchanger 24' and the primary heat exchanger 22' than blower housings of the prior art such as that shown in FIG. 1. This greater amount of distribution air is represented by the arrows 62 in FIG. 2. The enlarged air outlet opening 58 spreads the flow of air out over the furnace heat exchanger and thereby reduces the pressure loss across the furnace. This lowers the required pressure that the blower must generate, and enables the use of a more efficient motor to operate the blower.

As stated earlier, the larger air distribution outlet opening 58 is achieved by employing an exponentially increasing expansion angle in the design of the volute shaped outer wall 56 of the blower housing, as opposed to the constant increasing expansion angle employed in the design of prior art blower housings. The enlarged air outlet opening 58 is also achieved with the overall blower housing width dimension, the length dimension and the depth dimension of the blower housing 48 being the same as that of prior art blower housings. As the blower housing volute outer wall 56 extends around the blower housing in the rotation direction of the fan wheel, the scroll volume aggressively becomes larger in the interior of the housing. This is especially true as the outer wall 56 approaches the air outlet opening 58. This increase in the interior volume enables exhaust velocities of air flow to be reduced, and creates a blower housing where a greater portion of the air flow velocity head is converted to static pressure. This increases efficiency because the air flow velocity head energy would have been lost outside of the scroll interior. This further increases the overall efficiency of the blower housing of the invention.

Figure 4:
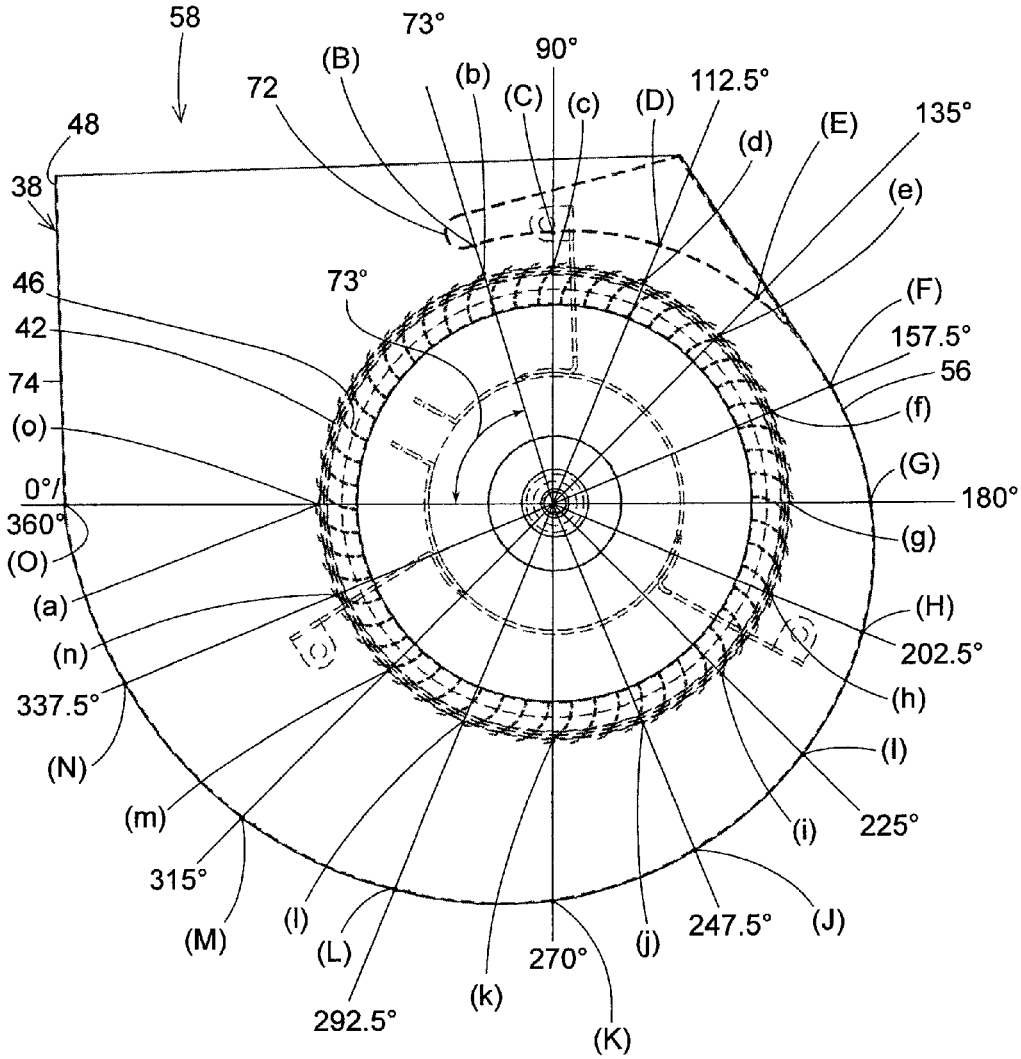
FIG. 4 is a side elevation view of the blower housing of FIG. 3, and is a schematic representation of the dimensional relationships between the circumference of the fan wheel and the volute shaped outer wall of the blower housing of the invention.

FIG. 4 is a schematic representation of a side view of the blower housing volute outer wall 56 and the fan wheel 42 in the blower housing. The description of the blower housing 48 and the fan wheel 42 to follow is only one exemplary embodiment of the blower 38 of the invention. In other environments the construction of the blower housing and fan wheel may vary. However, as will be explained, the construction and the design of the blower housing outer wall 56 is based on an exponentially increasing expansion angle, where many prior art blower housings have been designed with a constant increasing expansion angle. Furthermore, the construction of the volute outer wall radially opposite any point on the circumference of the fan wheel is proportioned to the circumferential dimension of the fan wheel at that point, raised to an exponential value.

The blower housing outer wall 56 has a volute shaped portion that defines a majority of the length of the outer wall. The volute shaped portion of the outer wall 56 could also be described as having a scroll configuration or a spiral configuration. These general configurations are common to blower housings of the prior art. However, the novel configuration of the blower housing outer wall 56 of the invention is defined as having an exponentially increasing expansion angle as the volute shaped wall 56 extends in the rotation direction around the fan wheel axis of rotation 44. As viewed in FIG. 4, the outer wall includes a cut-off portion 72. The outer wall also includes a straight portion 74 at the enlarged air outlet opening 58. The straight portion 74 of the outer wall has no expansion angle and extends in a straight line. The volute outer wall 56 is the length of the outer wall that extends from the cutoff 72 to the straight portion 74.

FIG. 4 illustrates the dimensional relationship between the portion of the circumference of the fan wheel 42 that is positioned radially inside the volute shape portion of the outer wall 56 of the invention. The fan wheel 42 shown in FIG. 4 has a diameter dimension and circumferential dimension. In the explanation of the construction of the blower housing outer wall 56 to follow, the dimensions of the outer wall are based on circumferential dimensions of the fan wheel circumference. These circumferential dimensions of the fan wheel begin at point (b) on the fan wheel shown in FIG. 4. The dimensions are measured around in a clockwise rotation direction as shown in FIG. 4 to an ending point on the fan wheel that coincides with the point (o). A line drawn from the fan wheel axis of rotation 44 through the fan wheel beginning point (a) marks a zero degree reference point on the circumference of the fan wheel.

Beginning from the fan wheel reference point (a) at the zero degree circumference of the fan wheel, and extending around the fan wheel circumference in the clockwise direction of rotation of the fan wheel shown in FIG. 4, a second point (b) is positioned on the fan wheel 73 degrees from the first point (a). Point (b) is the beginning of the portion of the fan wheel circumferential dimensions that are used in determining the dimensions of the outer wall 56. A third point (c) is positioned on the fan wheel 90 degrees from the first point (a). Point (c) is also 17 degrees from point (b) which is 0.047 of the fan wheel circumference. A fourth point (d) is positioned on the fan wheel 112.5 degrees from the first point (a). Point (d) is also 39.5 degrees from point (b) which is 0.110 of the fan wheel circumference. A fifth point (e) is positioned on the fan wheel 135 degrees from the first point (a). Point (e) is also 62 degrees from point (b) which is 0.172 of the fan wheel circumference. A sixth point (f) is positioned on the fan wheel 157.5 degrees from the first point (a). Point (f) is also 84.5 degrees from point (b) which is 0.235 of the fan wheel circumference. A seventh point (g) is positioned on the fan wheel 180 degrees from the first point (a). Point (g) is also 107 degrees from point (b) which is 0.297 of the fan wheel circumference. An eighth point (h) is positioned on the fan wheel 202.5 degrees from the first point (a). Point (h) is also 129.5 degrees from point (b) which is 0.360 of the fan wheel circumference. A ninth point (i) is positioned on the fan wheel 225 degrees from the first point (a). Point (i) is also 152 degrees from point (b) which is 0.422 of the fan wheel circumference. A tenth point (j) is positioned on the fan wheel 247.5 degrees from the first point (a). Point (j) is also 174.5 degrees from point (b) which is 0.485 of the fan wheel circumference. An eleventh point (k) is positioned on the fan wheel 270 degrees from the first point (a). Point (k) is also 197 degrees from point (b) which is 0.547 of the fan wheel circumference. A twelfth point (l) is positioned on the fan wheel 292.5 degrees from the first point (a). Point (l) is also 219.5 degrees from point (b) which is 0.610 of the fan wheel circumference. A thirteenth point (m) is positioned on the fan wheel 315 from the first point (a). Point (m) is also 242 degrees from point (b) which is 0.672 of the fan wheel circumference. A fourteenth point (n) is positioned on the fan wheel 337.5 degrees from the first point (a). Point (n) is also 264.5 degrees from point (b) which is 0.735 of the fan wheel circumference. A fifteenth point (o) is positioned on the fan wheel 360 degrees from the first point (a) and coincides with the first point. Point (o) is also 287 degrees from point (b) which is 0.797 of the fan wheel circumference. These multiple points on the fan wheel are radially aligned with points on the blower housing outer wall 56. The circumferential distances of the fan wheel points (b-o) from the point (b) on the fan wheel are employed in calculating the distance of the blower housing outer wall 56 from the circumference of the fan wheel 42 at each of the radially aligned points on the blower housing outer wall. In this way the exponentially increasing expansion angle of the blower housing of the invention is determined.

The beginning of the volute or scroll shaped configuration of the outer wall 56 begins just past the cut-off portion 82 in the direction of rotation of the fan wheel 42. The beginning end of the volute shaped portion of the outer wall 56 begins at a point (B) on the outer wall 56. Point (B) is radially aligned with the 73 degree point (b) on the circumference of the fan wheel 42. From this beginning point (B) on the volute shaped portion on the outer wall 56, the outer wall has points (C, D, E, F, G, H, I, J, K, L, M, N, O) that are radially spaced outwardly from and correspond to the respective circumferentially spaced points (c, d, e, f, g, h, i, j, k, l, m, n, o) on the circumference on the fan wheel 42. The volute shaped portion of the outer wall 56 has an ending point (O) that is radially aligned with the zero degree fan wheel beginning point (a) and the 360 degree fan wheel ending point (o).

The radial spacing between the points on the fan wheel circumference and their radially aligned corresponding points on the volute shaped portion of the outer wall 56 is determined by the equation:

$$Y=A+Bx^c$$

In the above equation, the "x" value is the circumferential distance from point (b) on the fan wheel circumference at which the radial spacing between the fan wheel and the volute shaped portion of the outer wall is being calculated. This value is raised to the exponential power of (c). In the preferred embodiment of the invention, it has been determined empirically that the value (c) for points on the circumference of the fan wheel 42 from the fan wheel point (b) to the 270 degree fan wheel point (k) is an exponent in the range of 1.2 to 1.4. Preferably, the exponent is 1.3. For points on the circumference of the fan wheel from the 270 degree fan wheel point (k) to the fan wheel point corresponding to 360 degrees (o), the value of the exponent "c" is in the range of 1.5 to 2.1. Preferably, the exponent is 1.81.

In the above-referenced equation, the "A" factor is a minimum height factor for the blower housing 48. In the disclosed embodiment, the minimum height factor "A" is 0.625 inches. The factor "B" in the above equation is a factor picked by the furnace designer to create as large of an exhaust opening as is practical, along with keeping the blower housing within size restrictions of the furnace enclosure 12'. The furnace designer designs the blower housing to allow a reasonable flow of air around the blower housing in the enclosure 12', while trying to hold down the exponential expansion of the blower housing outer wall 56 as much as possible, while at the same time obtaining the primary objective of a large air outlet opening 58. In the disclosed embodiment, the factor "B" is 0.05645 for points on the circumference of the fan wheel 42 from the fan wheel point (b) to the 270 degree fan wheel point (k), and is 0.0128 for the points on the circumference of the fan wheel from the 270 degree point (k) to the 360 degree fan wheel point (o).

The exponentially increasing expansion angle of the volute shaped portion of the outer wall 56 of the invention is based on a fan wheel 42 having a diameter dimension D of 10.625 inches. The size of the fan wheel influences the circumferential dimensions measured to the fan wheel points (b, c, d, e, f, g, h, i, j, k, l, m, n, o) which are raised to an exponential value to obtain the radial spacing between each of the respective points on the circumference of the fan wheel 42 and a radially aligned point on the volute outer wall 56. A blower housing having a volute outer wall 56 designed according to the earlier set forth equation provides an enlarged air outlet opening 58 without significantly increasing the overall dimensions of the blower housing 48 from that of prior art blower housings.

In alternate embodiments of the invention, the expansion angle of the volute outer wall 56 of the blower housing could increase exponentially with there being a single exponent value for the entire length of the volute shaped outer wall 56.

Figure 5:
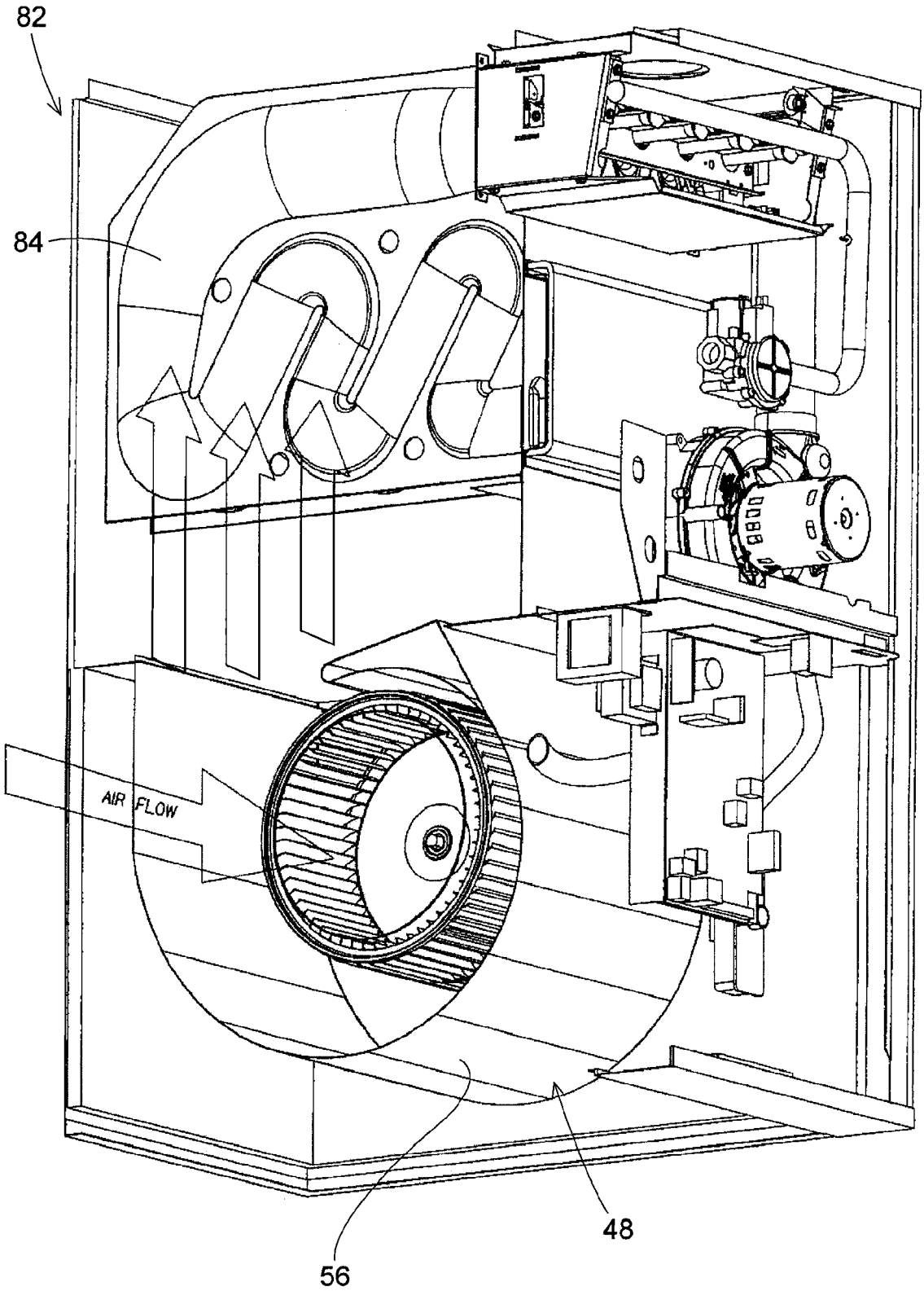
FIG. 5 is a partial view of a low profile 80+ furnace employing the blower housing of the invention.

In further embodiments of the invention, the blower housing of the invention could be employed in a low profile furnace, specifically an 80+ AFUE furnace, as well as in other types of furnaces and air handlers, and also in AC units. The alternate embodiment of a 80+ furnace is illustrated in FIG. 5. FIG. 5 illustrates the earlier described blower housing 48 of the invention employed in a low profile furnace 82, where the low profile furnace employs only a primary heat exchanger 84 and does not include a secondary heat exchanger as described earlier. Used in this environment, the blower housing 48 of the invention has similar static efficiency to that of a regular profile blower. The use of the blower housing 48 in a low profile furnace allows savings in shipping costs and sheet metal cost. The particular two stage exponential growth of the volute outer wall 56 of the blower housing 48 provides similar performance and efficiency to the low profile furnace as that of a regular profile blower in a low profile size.

Although the above equation and the above described method of designing the volute shaped outer wall of a blower housing based on the circumference dimensions of the fan wheel are described with reference to a particular fan wheel diameter dimension, there are particular blower housing and fan wheel dimension relationships that provide the synergistic effect of the increased efficiency of the blower housing of the invention. In the blower housing of the invention these synergistic results are achieved when the ratio of the minimum radial dimension of the air outlet opening (for example, the minimum dimension between the cutoff 72 and the straight portion of the blower housing outer wall 48 shown in FIG. 4), and the fan wheel outer diameter dimension is at least 0.73. In addition, the ratio of the distance dimension between the fan wheel axis of rotation 44 and the second end of the blower housing outer wall volute shaped portion, and the fan wheel outer diameter dimension is at least 0.91. Furthermore, in the preferred embodiment the radial distance between the fan wheel axis of rotation 44 and the volute shaped portion of the blower housing outer wall increases as the volute shaped portion extends from a first end of the volute shaped portion around the fan wheel to the second end of the volute shaped portion. Preferably the increase is exponential.

The dimensional relationships between the fan wheel and the blower housing outer wall of the invention set forth above result in the synergistic increase in the efficiency of the blower housing of the invention. This synergistic increase in efficiency is the result of three basic principles.

(1) The enlarged air outlet opening of the blower housing spreads out the flow of air exiting the blower housing over the furnace heat exchanger to a greater extent than prior art blower housings, and thereby reduces the pressure loss across the furnace. This lowers the required pressure that the blower must generate.

(2) The flow of air moving through the fan wheel is concentrated in the last half of the scroll configuration of the blower housing, and especially in the last 90° of the scroll configuration where the outer wall increases at an expansion angle of 10° or greater. This creates a higher air flow velocity through the forward-curved blades of the fan wheel, which increases static pressure gained on the fan wheel due to the coriollis effect. The higher air flow velocity also increases the velocity head off of the forwarded-curved blades of the fan wheel. This effect reduces the size of the fan wheel required in the blower housing for an equal powered blower, and increases the efficiency due to greater pressure being generated on the fan wheel blades.

(3) The blower housing volume aggressively becomes larger in the direction of fan wheel rotation in the blower housing of the invention, especially toward the air outlet opening. This enables the exhaust velocities of the air flow to be reduced, and creates a blower housing where a greater portion of the air flow velocity head is converted to static pressure. This increases the efficiency of the blower housing because this velocity head energy would have been lost outside of the blower housing. This further increases the overall efficiency of the system.

Figure 6:
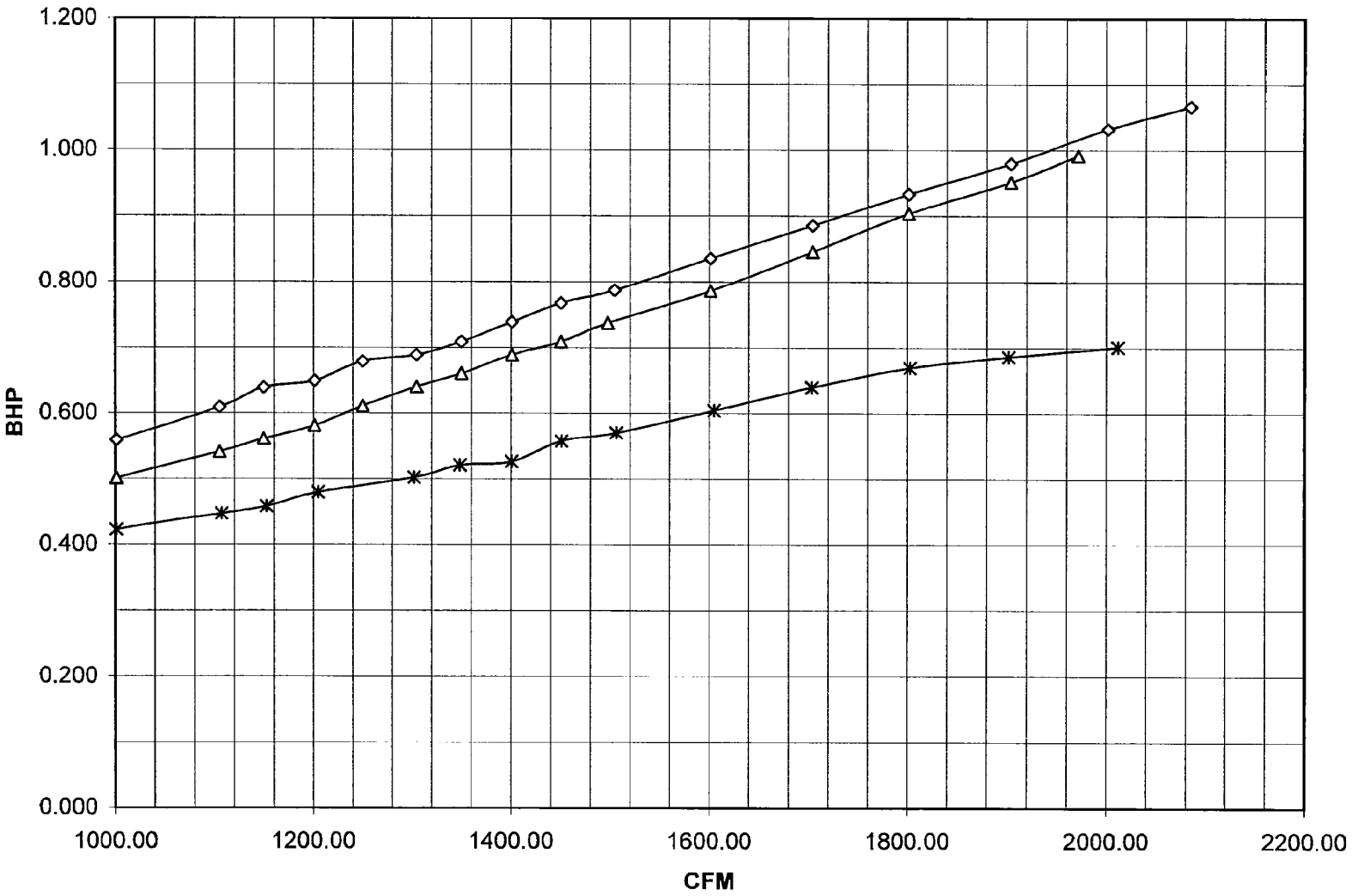
FIGS. 6 and 7 are graphs comparing the operation of blower housings of the invention with those of the prior art.

FIG. 6 is a graph illustrating the gain in efficiency of a high efficiency 90+ furnace employing the blower housing of the invention as compared to high efficiency 90+ furnaces of the prior art. In FIG. 6, the bottommost line on the graph represents the operation of the blower housing of the invention in a 90+ furnace. The other two graph lines represent the operation of 90+ furnaces of the prior art. From this graph it can be seen that the blower housing of the invention requires less horsepower of the fan wheel motor to move a volume of air through the furnace than the blower housings of the prior art.

Figure 7:
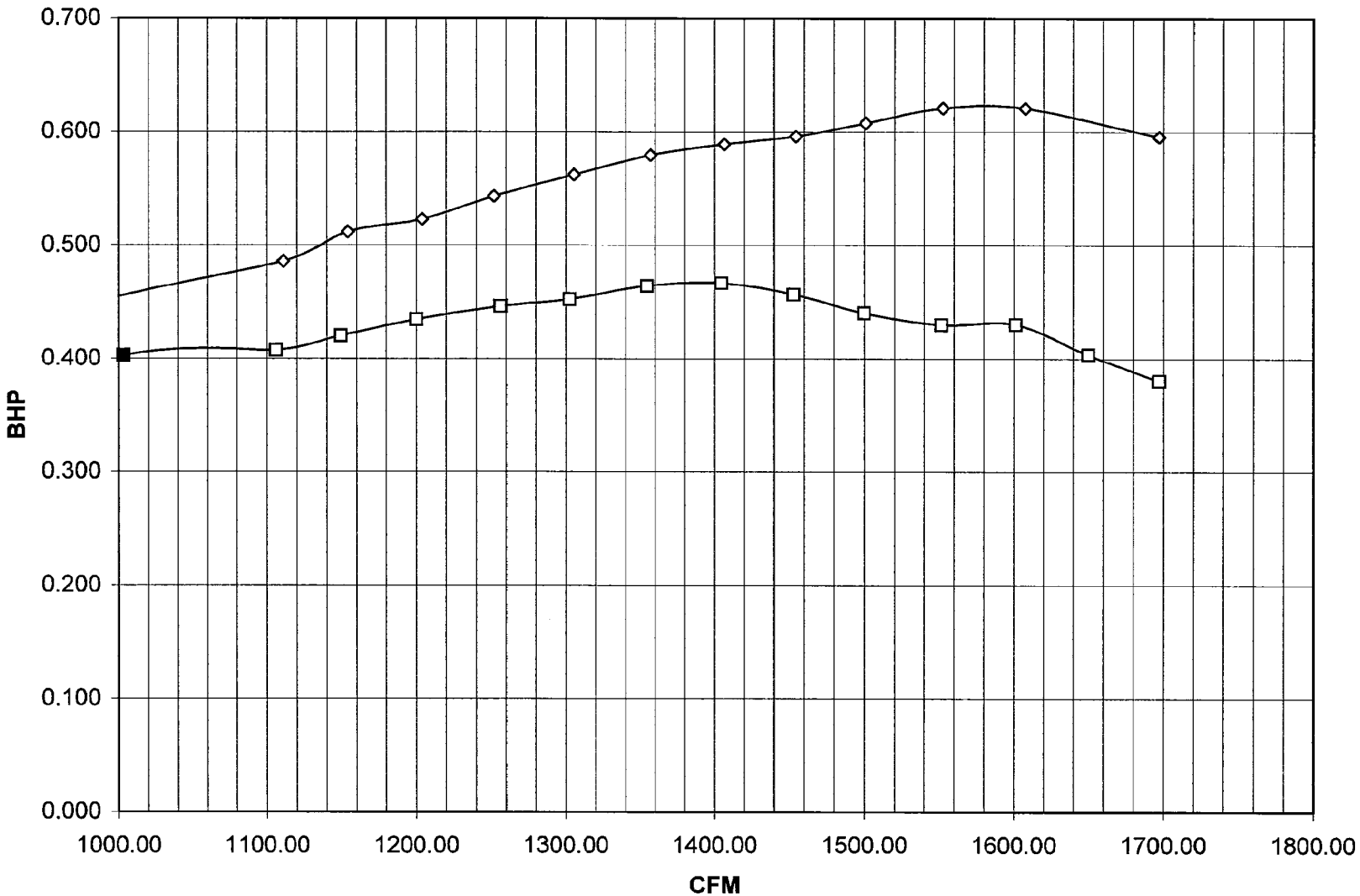

FIG. 7 is a graph similar to that of FIG. 6, but showing a comparison of the low profile 80+ blower housing of the invention compared with a low profile blower housing of the prior art. In FIG. 7, the lower line on the graph represents the operation of the low profile blower housing of the invention. In this graph it can also be seen that the low profile blower housing of the invention requires less horsepower to move a volume of air as compared to a blower housing of the prior art.

The above described embodiments of the invention were chosen in order to best explain the principles of the invention and its practical application to thereby enable others skilled in the art to best utilize the invention in various embodiments and with various modifications as are suited to the particular use contemplated.

As various modifications could be made in the constructions herein described and illustrated without departing from the scope of the invention, it is intended that all matter contained in the foregoing description or shown in the accompanying drawings shall be interpreted as illustrative rather than limiting. Thus, the breadth and scope of the present invention should not be limited by any of the above-described exemplary embodiments, but should be defined only in accordance with the following claims appended hereto and their equivalents.

What is claimed is:

1. A high efficiency furnace comprising:

a furnace enclosure having an interior volume and a distribution air outlet opening on the enclosure that is adapted for communication with an air distribution system;

a primary heat exchanger in the furnace enclosure interior volume, the primary heat exchanger being adjacent the distribution air outlet opening;

a secondary heat exchanger in the furnace enclosure interior volume, the secondary heat exchanger being adjacent the primary heat exchanger and being separate from the primary heat exchanger;

a fan wheel in the furnace enclosure interior volume, the fan wheel having an outer diameter dimension, an axis of rotation that defines mutually perpendicular axial and radial directions, and the fan wheel being rotatable in a rotation direction around the axis of rotation;

a blower housing in the furnace enclosure interior volume, the blower housing having an interior volume containing the fan wheel and an air flow outlet opening positioned adjacent the secondary heat exchanger to direct a flow of air from the blower housing interior volume through the air flow outlet opening, then through the secondary heat exchanger, then through the primary heat exchanger, then through the furnace enclosure distribution air outlet opening, the blower housing having first and second side walls on axially opposite ends of the fan wheel and on opposite sides of the air flow outlet opening, and the blower housing having an outer wall between the first and second side walls, the outer wall having a volute portion that spirals away from the fan wheel axis of rotation as it extends from a first end of the volute portion at one side of the air flow outlet opening around the blower housing interior volume to a second end of the volute portion at an opposite side of the air flow outlet opening from the first end, and the blower housing outer wall having a radial dimension from the fan wheel axis of rotation to the second end of the outer wall that is at least 0.91 times the fan wheel outer diameter dimension, and the blower housing air outlet opening having a minimal radial dimension that is at least 0.73 times the fan wheel outer diameter dimension.

2. The high efficiency furnace of claim 1, further comprising:

the air outlet opening of the blower housing being rectangular and being bounded by the first and second side walls on opposite sides of the air outlet opening, by a first end edge of the blower housing outer wall at one side of the air outlet opening and by a second end edge of the blower housing outer wall at an opposite side of the air outlet opening from the first end edge, and a distance dimension across the air outlet opening between the first end edge and the second end edge of the blower housing outer wall is at least 0.73 times the fan wheel outer diameter dimension.

3. The high efficiency furnace of claim 1, further comprising:

the volute portion of the blower housing outer wall having a radial distance dimension from the fan wheel axis of rotation that increases at an exponential rate as the volute portion extends in the rotation direction around the blower housing interior volume.

4. The high efficiency furnace of claim 1, further comprising:

the volute portion of the blower housing outer wall having a radial distance dimension from the fan wheel axis of rotation that increases at an exponential rate as the volute portion extends from the first end of the volute portion around the blower housing interior volume.

5. The high efficiency furnace of claim 1, further comprising;

the volute portion of the blower housing outer wall having a radial distance dimension from the fan wheel axis of rotation that increases at an exponential rate as the volute portion extends from the first end of the volute portion around the blower housing interior volume to the second end of the volute portion.

6. A high efficiency furnace comprising:

a furnace enclosure having an interior volume and a distribution air outlet opening on the furnace enclosure that is adapted for communication with an air distribution system;

a primary heat exchanger in the furnace enclosure interior volume, the primary heat exchanger being adjacent the distribution air outlet opening;

a secondary heat exchanger in the furnace enclosure interior volume, the secondary heat exchanger being adjacent the primary heat exchanger and being separate from the primary heat exchanger;

a fan wheel in the furnace enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the furnace enclosure interior volume, the blower housing containing the fan wheel and having an air outlet opening positioned adjacent the secondary heat exchanger to direct a flow of air from the air outlet opening through the secondary heat exchanger, then through the primary heat exchanger and then through the distribution air outlet opening of the furnace enclosure, the air outlet opening having a minimum radial dimension, a ratio of the minimum radial dimension and the fan wheel outer diameter dimension being at least 0.73, the blower housing having an outer wall with a volute shaped portion having a length that extends from a first end of the volute shaped portion around the fan wheel in the rotation direction to a second end of the volute shaped portion, the first end of the volute shaped portion being spaced radially a first distance dimension from the fan wheel axis of rotation and the second end of the volute shaped portion being spaced radially a second distance dimension from the fan wheel axis of rotation that is larger than the first distance, a ratio of the second distance dimension and the fan wheel outer diameter dimension being at least 0.91, and the volute shaped portion of the blower housing outer wall having a generally increasing expansion angle as the volute shaped portion extends in the rotation direction around the fan wheel.

7. The high efficiency furnace of claim 6, further comprising:

the expansion angle of the blower housing outer wall volute shaped portion increasing exponentially as the volute shaped portion extends in the rotation direction around the fan wheel.

8. The high efficiency furnace of claim 6, further comprising:

the expansion angle of the blower housing outer wall volute shaped portion increasing exponentially as the volute shaped portion extends from the first end of the volute shaped portion in the rotation direction around the blower housing to the second end of the volute shaped portion.

9. The high efficiency furnace of claim 6, further comprising:

the expansion angle of the blower housing outer wall volute shaped portion increasing exponentially as the volute shaped portion extends from the first end of the volute shaped portion in the rotation direction around the fan wheel to the second end of the volute shaped portion.

10. The high efficiency furnace of claim 6, further comprising:

the blower housing outer wall having a straight portion that extends from the second end of the volute shaped portion to the air outlet opening of the blower housing.

11. The high efficiency furnace of claim 10, further comprising:

the straight portion of the blower housing outer wall extending along a line that is oriented at a right angle relative to a line extending between the fan wheel axis of rotation and the second end of the volute shaped portion of the blower housing outer wall.

12. The high efficiency furnace of claim 11, further comprising:

a radially spaced distance dimension between the fan wheel circumference and the second end of the volute shaped portion of the blower housing outer wall being larger than half of the fan wheel diameter dimension.

13. The high efficiency furnace of claim 6, further comprising:

the air outlet opening minimum radial dimension being along a line that is parallel to a line extending between the fan wheel axis of rotation and the second end of the volute shaped portion of the blower housing outer wall.

14. The high efficiency furnace of claim 6, further comprising:

the blower housing outer wall volute shaped portion extending from a beginning point on the volute shaped portion around the fan wheel in the rotation direction to an ending point on the volute shaped portion, the beginning point on the volute shaped portion being at a smallest radial distance from the fan wheel axis of rotation of a plurality of points on the volute shaped portion, and the ending point on the volute shaped portion being at a largest radial distance from the fan wheel axis of rotation of the plurality of points on the volute shaped portion;

a beginning point on the fan wheel circumference being positioned on a radial line extending from the fan wheel axis of rotation to the beginning point on the volute shaped portion, and an ending point on the fan wheel circumference being positioned on a radial line extending from the fan wheel axis of rotation to the ending point on the volute shaped portion; and a radial distance between the beginning point of the fan wheel circumference and the beginning point of the blower housing volute shaped portion being proportional to a circumferential distance in the rotation direction from the ending point on the fan wheel circumference to the beginning point on the fan wheel circumference raised to an exponent.

15. The high efficiency furnace of claim 14, further comprising:

the exponent being in a range from 1.2 to 1.4.

16. The high efficiency furnace of claim 14, further comprising:

a radial distance between the ending point on the fan wheel circumference and the ending point of the blower housing outer wall volute shaped portion is proportional to a circumferential distance dimension of the fan wheel raised to a second exponent.

17. The high efficiency furnace of claim 16, further comprising:

the second exponent being in a range from 1.5 to 2.1.

18. The high efficiency furnace of claim 14, further comprising:

the radial distance between any one point on the fan wheel and any radially aligned point on the blower housing outer wall volute shaped portion is proportional to a circumferential distance in the rotation direction from the ending point on the fan wheel circumference to the any one point on the fan wheel circumference raised to an exponent.

19. The high efficiency furnace of claim 14, further comprising:

the radial distance between any one point on the fan wheel circumference from the beginning point on the fan wheel to a second point that is at most 270° in the rotation direction, and any radially aligned point on the blower housing volute outer wall is proportional to a circumferential distance in the rotation direction from the beginning point on the fan wheel circumference to the any one point on the fan wheel circumference raised to an exponent being in a range from 1.2 to 1.4.

20. The high efficiency furnace of claim 19, further comprising:

the radial distance between any further one point on the fan wheel circumference between the second point 270° in the rotation direction and the ending point on the fan wheel, and any radially aligned point on the blower housing volute outer wall is proportional to a circumferential distance in the rotation direction from the beginning point on the fan wheel circumference to the any further one point on the fan wheel circumference raised to an exponent being in a range from 1.5 to 2.1.

21. A furnace comprising:

a furnace enclosure having an interior volume and a distribution air outlet opening on the furnace enclosure that is adapted for communication with an air distribution system;

a primary heat exchanger in the furnace enclosure interior volume, the primary heat exchanger being adjacent the distribution air outlet opening;

a fan wheel in the furnace enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the furnace enclosure interior volume, the blower housing containing the fan wheel and having an air outlet opening positioned adjacent the primary heat exchanger to direct a flow of air from the air outlet opening through the primary heat exchanger and then through the distribution air outlet opening of the furnace enclosure, the air outlet opening having a minimum radial dimension, a ratio of the minimum radial dimension and the fan wheel outer diameter dimension being at least 0.73, the blower housing having an outer wall with a volute shaped portion having a length that extends from a first end of the volute shaped portion around the fan wheel in the rotation direction to a second end of the volute shaped portion, the first end of the volute shaped portion being spaced radially a first distance dimension from the fan wheel axis of rotation and the second end of the volute shaped portion being spaced radially a second distance dimension from the fan wheel axis of rotation that is larger than the first distance, a ratio of the second distance dimension and the fan wheel outer diameter dimension being at least 0.91, and the volute shaped portion of the blower housing outer wall having a generally increasing expansion angle as the volute shaped portion extends in the rotation direction around the fan wheel.

22. The furnace of claim 21, further comprising:

the expansion angle of the blower housing outer wall volute shaped portion increasing exponentially as the volute shaped portion extends in the rotation direction around the fan wheel.

23. The furnace of claim 21, further comprising:

the expansion angle of the blower housing outer wall volute shaped portion increasing exponentially as the volute shaped portion extends from the first end of the volute shaped portion in the rotation direction around the blower housing.

24. The furnace of claim 21, further comprising:

the expansion angle of the blower housing outer wall volute shaped portion increasing exponentially as the volute shaped portion extends from the first end of the volute shaped portion in the rotation direction around the fan wheel to the second end of the volute shaped portion.

25. The furnace of claim 21, further comprising:

the blower housing outer wall having a straight portion that extends from the second end of the volute shaped portion to the air outlet opening of the blower housing.

26. The furnace of claim 25, further comprising:

the straight portion of the blower housing outer wall extending along a line that is oriented at a right angle relative to a line extending between the fan wheel axis of rotation and the second end of the volute shaped portion of the blower housing outer wall.

27. The furnace of claim 21, further comprising:

the furnace is a low profile 80+ AFUE furnace.

28. A furnace comprising:

a furnace enclosure having an interior volume and a distribution air outlet opening on the furnace enclosure that is adapted for communication with an air distribution system;

a primary heat exchanger in the furnace enclosure interior volume, the primary heat exchanger being adjacent the distribution air outlet opening;

a fan wheel in the furnace enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the furnace enclosure interior volume, the blower housing containing the fan wheel and having an air outlet opening positioned adjacent the primary heat exchanger to direct a flow of air from the air outlet opening through the primary heat exchanger and then through the distribution air outlet opening of the furnace enclosure, the air outlet opening having a minimum radial dimension, a ratio of the minimum radial dimension and the fan wheel outer diameter dimension being at least 0.73, the blower housing having an outer wall with a volute shaped portion having a length that extends from a first end of the volute shaped portion around the fan wheel in the rotation direction to a second end of the volute shaped portion, the first end of the volute shaped portion being spaced radially a first distance dimension from the fan wheel axis of rotation and the second end of the volute shaped portion being spaced radially a second distance dimension from the fan wheel axis of rotation that is larger than the first distance, and the volute shaped portion of the blower housing outer wall having a generally increasing expansion angle as the volute shaped portion extends in the rotation direction around the fan wheel from the first end to the second end of the volute shaped portion.

29. The furnace of claim 28, further comprising:

the expansion angle of the blower housing outer wall volute shaped portion increasing exponentially as the volute shaped portion extends in the rotation direction around the fan wheel.

30. The furnace of claim 28, further comprising:

the expansion angle of the blower housing outer wall volute shaped portion increasing exponentially as the volute shaped portion extends from the first end of the volute shaped portion in the rotation direction around the blower housing.

31. The furnace of claim 28, further comprising:

the expansion angle of the blower housing outer wall volute shaped portion increasing exponentially as the volute shaped portion extends from the first end of the volute shaped portion in the rotation direction around the fan wheel to the second end of the volute shaped portion.

32. The furnace of claim 28, further comprising:

the blower housing outer wall having a straight portion that extends from the second end of the volute shaped portion to the air outlet opening of the blower housing.

33. The furnace of claim 32, further comprising:

the straight portion of the blower housing outer wall extending along a line that is oriented at a right angle relative to a line extending between the fan wheel axis of rotation and the second end of the volute shaped portion of the blower housing outer wall.

34. A furnace comprising:

a furnace enclosure having an interior volume and a distribution air outlet opening on the furnace enclosure that is adapted for communication with an air distribution system;

a primary heat exchanger in the furnace enclosure interior volume, the primary heat exchanger being adjacent the distribution air outlet opening;

a fan wheel in the furnace enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the furnace enclosure interior volume, the blower housing containing the fan wheel and having an air outlet opening positioned adjacent the primary heat exchanger to direct a flow of air from the air outlet opening through the primary heat exchanger and then through the distribution air outlet opening of the furnace enclosure, the air outlet opening having a minimum radial dimension, a ratio of the minimum radial dimension and the fan wheel outer diameter dimension being at least 0.73, the blower housing having an outer wall with a volute shaped portion having a length that extends from a first end of the volute shaped portion around the fan wheel in the rotation direction to a second end of the volute shaped portion, the first end of the volute shaped portion being spaced radially a first distance dimension from the fan wheel axis of rotation and the second end of the volute shaped portion being spaced radially a second distance dimension from the fan wheel axis of rotation that is larger than the first distance, and a ratio of the second distance dimension and the fan wheel outer diameter dimension being at least 0.91.

35. The furnace of claim 34, further comprising:

the expansion angle of the blower housing outer wall volute shaped portion increasing exponentially as the volute shaped portion extends in the rotation direction around the fan wheel.

36. The furnace of claim 34, further comprising:

the expansion angle of the blower housing outer wall volute shaped portion increasing exponentially as the volute shaped portion extends from the first end of the volute shaped portion in the rotation direction around the blower housing.

37. The furnace of claim 34, further comprising:

the expansion angle of the blower housing outer wall volute shaped portion increasing exponentially as the volute shaped portion extends from the first end of the volute shaped portion in the rotation direction around the fan wheel to the second end of the volute shaped portion.

38. The furnace of claim 34, further comprising:

the blower housing outer wall having a straight portion that extends from the second end of the volute shaped portion to the air outlet opening of the blower housing.

39. The furnace of claim 38, further comprising:

the straight portion of the blower housing outer wall extending along a line that is oriented at a right angle relative to a line extending between the fan wheel axis of rotation and the second end of the volute shaped portion of the blower housing outer wall.

40. An air handler comprising:

an enclosure having an interior volume and a distribution air outlet opening on the enclosure that is adapted for communication with an air distribution system;

a temperature transfer means in the enclosure interior volume, the temperature transfer means being adjacent the distribution air outlet opening;

a fan wheel in the enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the enclosure interior volume, the blower housing containing the fan wheel and having an air outlet opening positioned adjacent the temperature transfer means to direct a flow of air from the air outlet opening through the temperature transfer means and then through the distribution air outlet opening of the enclosure, the air outlet opening having a minimum radial dimension, a ratio of the minimum radial dimension and the fan wheel outer diameter dimension being at least 0.73, the blower housing having an outer wall with a volute shaped portion having a length that extends from a first end of the volute shaped portion around the fan wheel in the rotation direction to a second end of the volute shaped portion, the first end of the volute shaped portion being spaced radially a first distance dimension from the fan wheel axis of rotation and the second end of the volute shaped portion being spaced radially a second distance dimension from the fan wheel axis of rotation that is larger than the first distance, a ratio of the second distance dimension and the fan wheel outer diameter dimension being at least 0.91, and the volute shaped portion of the blower housing outer wall having a generally increasing expansion angle as the volute shaped portion extends in the rotation direction around the fan wheel.

41. The air handler of claim 40, further comprising:

the expansion angle of the blower housing outer wall volute shaped portion increasing exponentially as the volute shaped portion extends in the rotation direction around the fan wheel.

42. The air handler of claim 40, further comprising:

the expansion angle of the blower housing outer wall volute shaped portion increasing exponentially as the volute shaped portion extends from the first end of the volute shaped portion in the rotation direction around the blower housing.

43. The air handler of claim 40, further comprising:

the expansion angle of the blower housing outer wall volute shaped portion increasing exponentially as the volute shaped portion extends from the first end of the volute shaped portion in the rotation direction around the fan wheel to the second end of the volute shaped portion.

44. The air handler of claim 40, further comprising:

the blower housing outer wall having a straight portion that extends from the second end of the volute shaped portion to the air outlet opening of the blower housing.

45. The air handler of claim 44, further comprising:

the straight portion of the blower housing outer wall extending along a line that is oriented at a right angle relative to a line extending between the fan wheel axis of rotation and the second end of the volute shaped portion of the blower housing outer wall.

46. An air handler comprising:

an enclosure having an interior volume and a distribution air outlet opening on the enclosure that is adapted for communication with an air distribution system;

a temperature transfer means in the enclosure interior volume, the temperature transfer means being adjacent the distribution air outlet opening;

a fan wheel in the enclosure interior volume, the fan wheel having an outer diameter dimension and a circumference dimension, the fan wheel having a center axis of rotation that defines mutually perpendicular axial and radial directions and the fan wheel being rotatable about the center axis of rotation in a rotation direction;

a blower housing in the enclosure interior volume, the blower housing containing the fan wheel and having an air outlet opening, the blower housing having an outer wall with a length that extends from a first end of the length around the fan wheel in the rotation direction to the second end of the length, the first end of the length being spaced radially a first distance dimension from the fan wheel axis of rotation and the second end of the length being spaced radially a second distance dimension from the fan wheel axis of rotation that is larger than the first distance, the air outlet opening being between the first and second ends of the outer wall length, the air outlet opening having a minimum dimension between the first and second ends of the outer wall length, and a ratio of the minimum dimension and the fan wheel outer diameter dimension being at least 0.73.

47. The air handler of claim 46, further comprising:

the length of the blower housing outer wall having a generally increasing expansion angle as the length extends in the rotation direction around the fan wheel.

48. The air handler of claim 47, further comprising:

the expansion angle of the blower housing outer wall length increasing exponentially as the length extends in the rotation direction around the fan wheel.

49. The air handler of claim 47, further comprising:

the expansion angle of the blower housing outer wall length increasing exponentially as the length extends from the first end of the length in the rotation direction around the blower housing.

50. The air handler of claim 47, further comprising:

the expansion angle of the blower housing outer wall length increasing exponentially as the length extends from the first end of the length in the rotation direction around the fan wheel to the second end of the length.

51. The air handler of claim 46, further comprising:

a ratio of the second distance dimension and the fan wheel outer diameter dimension being at least 0.91.

* * * * *